US012716212B2

(12) United States Patent
Song et al.

(10) Patent No.: US 12,716,212 B2
(45) Date of Patent: Aug. 25, 2026

(54) FASTENING DEVICE FOR DIFFERENT COMPONENTS

(71) Applicant: SUNGBO INDUSTRIAL CO., LTD., Incheon-si (KR)

(72) Inventors: Keun Chul Song, Seoul-si (KR); Hyun Soo Lee, Incheon-si (KR); Min Gyun Jin, Incheon-si (KR); Jong Gwi Song, Incheon-si (KR)

(73) Assignee: Sungbo Industrial Co., Ltd., Incheon-si (KR)

( * ) Notice: Subject to any disclaimer, the term of this patent is extended or adjusted under 35 U.S.C. 154(b) by 374 days.

(21) Appl. No.: 18/457,704

(22) Filed: Aug. 29, 2023

(65) Prior Publication Data

US 2024/0076857 A1 Mar. 7, 2024

(30) Foreign Application Priority Data

Sep. 7, 2022 (KR) ..... 10-2022-0113732

(51) Int. Cl.
*E02F 9/28* (2006.01)

(52) U.S. Cl.
CPC ..... *E02F 9/2841* (2013.01); *E02F 9/2825* (2013.01)

(58) Field of Classification Search
CPC ..... E02F 9/2808; E02F 9/2833; E02F 9/2841; E02F 9/2825; E02F 9/2858; E02F 9/2883
See application file for complete search history.

(56) References Cited

U.S. PATENT DOCUMENTS 4,408,681 A * 10/1983 Oshima ..... F16D 65/0977 188/73.38
4,663,867 A 5/1987 Hahn et al.
(Continued)

FOREIGN PATENT DOCUMENTS

KR 10-2006-0011366 A 2/2006
KR 10-1795580 B1 12/2017
(Continued)

OTHER PUBLICATIONS

Examination Report in Australian Patent Application No. 2023222859 dated Aug. 14, 2024.
(Continued)

*Primary Examiner* — Joseph M Rocca
*Assistant Examiner* — Robert E Pezzuto
(74) *Attorney, Agent, or Firm* — Knobbe, Martens, Olson & Bear, LLP

(57) ABSTRACT

A fastening device for different components is proposed. The device may include a first member having a through passage formed at a connecting end, and a second member including an insertion groove, into which a connecting end of a first member is introduced, and an inlet hole and an outlet hole, which are formed on the opposite side of the insertion groove to communicate with each other through the through passage. The device may also include a connector for fastening or releasing according to a rotational operation position while being inserted to reach the inlet hole, the through passage, and the outlet hole; and a damper positioned on one side of the connector and configured as a single elastic pressing body that prevents rotation of the connector and maintains a fixed state of the connector by contracting or restoring its original shape according to a rotational operation of the connector.

24 Claims, 15 Drawing Sheets

(56) References Cited

U.S. PATENT DOCUMENTS

| | | | | |
|---|---|---|---|---|
| 9,222,243 | B2 | 12/2015 | Cheyne et al. | |
| 10,577,778 | B2 | 3/2020 | Quarfordt et al. | |
| 2010/0162594 | A1* | 7/2010 | Bierwith | F16B 33/02 411/366.3 |
| 2012/0017474 | A1 | 1/2012 | Corredor et al. | |
| 2016/0083935 | A1 | 3/2016 | Edmonds | |
| 2019/0048561 | A1 | 2/2019 | Ryu et al. | |
| 2019/0203445 | A1 | 7/2019 | Song et al. | |
| 2020/0340219 | A1 | 10/2020 | Wells et al. | |
| 2022/0074172 | A1 | 3/2022 | Song et al. | |

FOREIGN PATENT DOCUMENTS

| | | | |
|---|---|---|---|
| KR | 10-1817064 | B1 | 1/2018 |
| KR | 10-2306607 | B1 | 9/2021 |
| WO | WO 2014/027909 | A2 | 2/2014 |
| WO | WO 2016/152674 | A1 | 9/2016 |

OTHER PUBLICATIONS

Office Action in Korean Patent Application No. 10-2022-0113732 dated Aug. 9, 2024.

* cited by examiner

FASTENING DEVICE FOR DIFFERENT COMPONENTS

CROSS-REFERENCE TO RELATED APPLICATION PATENT

This application claims priority to and the benefit of Korean Patent Application No. 10-2022-0113732 filed on Sep. 7, 2022, the disclosure of which is incorporated herein by reference in its entirety.

BACKGROUND

Technical Field

The present disclosure relates to a fastening device for different components, and more particularly, to a fastening device for different components, the device which passes through a connected portion between the first component and the second components to fix the same and maintains a fixed state using elasticity.

Description of Related Technology

A digging apparatus such as an excavator used in public works or mines is used to dig earth and stone and pile up the dug earth or stone to other locations or a cargo box of a vehicle.

SUMMARY

One aspect is a fastening device for different components with improved structure to securely maintain a fastening force of a connecting unit that connects the different components, the first component and second component.

Another aspect is a fastening device for different components with improved structure to prevent deformation, damage, and shortened lifespan of a fastening portion, especially a damper, caused by thermal stress in high-temperature environments, the damper which causes contraction or restoration of the connecting unit (due to elasticity) to maintain a fixed state of the connecting unit and prevent movement of the connecting unit.

Another aspect is a fastening device for different components with simplified structure of the damper for improved manufacturing and ease of use of the damper.

Another aspect is a fastening device for different components, the device comprising: a first member having a through passage formed at a connecting end; a second member formed with an insertion groove, into which a connecting end of a first member is introduced, and an inlet hole and an outlet hole, which are formed on the opposite side of the insertion groove to communicate with each other through the through passage; a connecting unit for fastening or releasing according to a rotational operation position while being inserted to reach the inlet hole, the through passage, and the outlet hole; and a damper positioned on one side of the connecting unit and configured as a single elastic pressing body that prevents rotation of the connecting unit and maintains a fixed state of the connecting unit by contracting or restoring its original shape according to a rotational operation of the connecting unit.

The first component may be a tooth adapter connected and fixed to an excavator bucket.

The second component may be a tooth point fitted to a connecting end of a tip of the tooth adapter.

The connecting unit may be configured in such a way that a smaller diameter fastening pin is formed on one side of a relatively larger diameter head, the head is inserted into the inlet hole on one side of the second component, and the fastening pin passes through the through passage formed in the first component to reach the outlet hole on the opposite side of the second component.

The connecting unit may be configured in such a way that a first flat surface and a second flat surface forming an angle of 90 degrees is milled on a part surface of a head in contact with the fastening pin, a fillet surface is formed at a corner between the first flat surface and the second flat surface, and the engagement member protrudes from a head surface facing the second flat surface.

The first flat surface may be in surface contact with the damper during an initial stage of insertion of the connecting unit and during releasing of the connecting unit.

The second flat surface may be in surface contact with the damper at a time of fastening and fixing by a rotational operation of the connecting unit.

The first flat surface and the second flat surface may be in surface contact with the damper in a non-pressed state.

The first flat surface and the second flat surface may be pressed by elastic pressure of the damper to prevent movement of the connecting unit.

Only during a forced rotational operation of the connecting unit, the fillet surface moves to change in position by overcoming the elastic pressure of the damper to facilitate a directional transition of the first flat surface and the second flat surface, and the fillet surface acts as an engagement device to maintain a state resulting from the directional transition until another forced rotational operation of the connecting unit occurs.

A length "L" from a center point to the fillet surface of the connecting unit may be longer than lengths "l1 and l2" from the center point to the first and second flat surfaces.

The engagement member may be inserted through a mounting groove formed in the inlet hole, and when the connecting unit is rotated, the engagement member may engage by moving along an arc-shaped guide groove formed along a rotational direction on an inner surface of the inlet hole.

In the present disclosure, the damper may have three parallel rows of first, second, and third functional surfaces spaced apart from each other, and the damper may be formed in a zigzag pattern in which a lower part of the first functional surface connected to a lower part of the second functional surface while an upper part of the second functional surface connected to an upper part of the third functional surface.

The damper may be in the form of 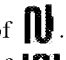 .

The damper may be in the form of 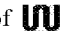 .

The damper may be formed of a metal material.

When the connecting unit is rotated counterclockwise and pressed for fastening, the upper part of the first functional surface may be pressed and contract, when the connecting unit is rotated counterclockwise by 45 degrees and pressed, the lower part of the second functional surface may contract, and when the connecting unit is rotated counterclockwise by 90 degrees to release pressure, the damper may restore its original shape due to elasticity, thereby maintaining a fastened state of the connecting unit. When the connecting unit is rotated clockwise to release pressure, the lower part of the second functional surface may be pressed and contract, when the connecting unit is further rotated clockwise by 45 degrees and pressed, the lower part of the second functional surface may contract further, and when the connecting unit is even further rotated clockwise by 90 degrees to release pressure, the damper may restore its original shape due to elasticity, thereby enabling the release and detachment of the connecting unit.

The damper may be inserted into and fixed to a receiving space communicatively formed on one side of an inlet hole into which the connecting unit is inserted.

The damper may be in surface contact with the connecting unit through a communicative portion of the receiving space.

The damper may be fixed in the receiving space by its own elastic force.

Separation of the damper received in the receiving space may be prevented due to a step formed in a lower side of the receiving space.

In a process for receiving the damper in the receiving space, an end of one side of the damper may be fitted and fixed to a holding pin protruding in an upper side of the receiving space.

In a process for receiving the damper in the receiving space, an end of one side of the damper may be fitted and fixed to a fixing protruding piece protruding vertically in a rear side of the receiving space.

DETAILED DESCRIPTION

A digging apparatus generally has a bucket coupled to a mechanical arm and used to dig and carry earth or stone. The end of the bucket is equipped with a plurality of tooth points which are used to dig and crush earth or stone. In this case, the tooth point is fitted into the front end of each of a plurality of tooth adapters connected to the bucket, and a separate connecting unit penetrates and is fastened and fixed to the portion connected to the fitting as described above.

When a digging operation is performed through such a digging apparatus, a direct digging operation such as digging an excavation spot, moving soil and gravel, and the like, is performed by the tooth points, and thus, the tooth points wear with the lapse of time.

Therefore, wear of the tooth points exceeds a set value (or a set state), it is necessary to replace the tooth points to ensure a smooth digging operation and protect the excavator. In this case, the connecting unit is separated, the tooth point is removed from the tooth adapter and then replaced.

Description will now be given in detail according to exemplary embodiments disclosed herein, with reference to the accompanying drawings. For the sake of brief description with reference to the drawings, the same or equivalent components may be provided with the same or similar reference numbers, and description thereof will not be repeated. In addition, in the following description of the embodiments, a detailed description of known functions and configurations incorporated herein will be omitted when it may impede the understanding of the embodiments.

While terms including ordinal numbers, such as "first" and "second," etc., may be used to describe various components, such components are not limited by the above terms. The above terms are used only to distinguish one component from another.

As used herein, the singular forms "a", "an," and "the" are intended to include the plural forms as well, unless the context clearly indicates otherwise.

In this application, each step described can be performed regardless of the listed order, except for the case where it must be performed in the listed order due to a special causal relationship.

It will be further understood that the terms "comprises," "comprising," "includes" and/or "including," when used herein, specify the presence of stated features, integers, steps, operations, elements, and/or components, but do not preclude the presence or addition of one or more other features, integers, steps, operations, elements, components, and/or groups thereof.

Hereinafter, a basic embodiment of the present disclosure will be described with reference to the accompanying drawings.

Figure 1:
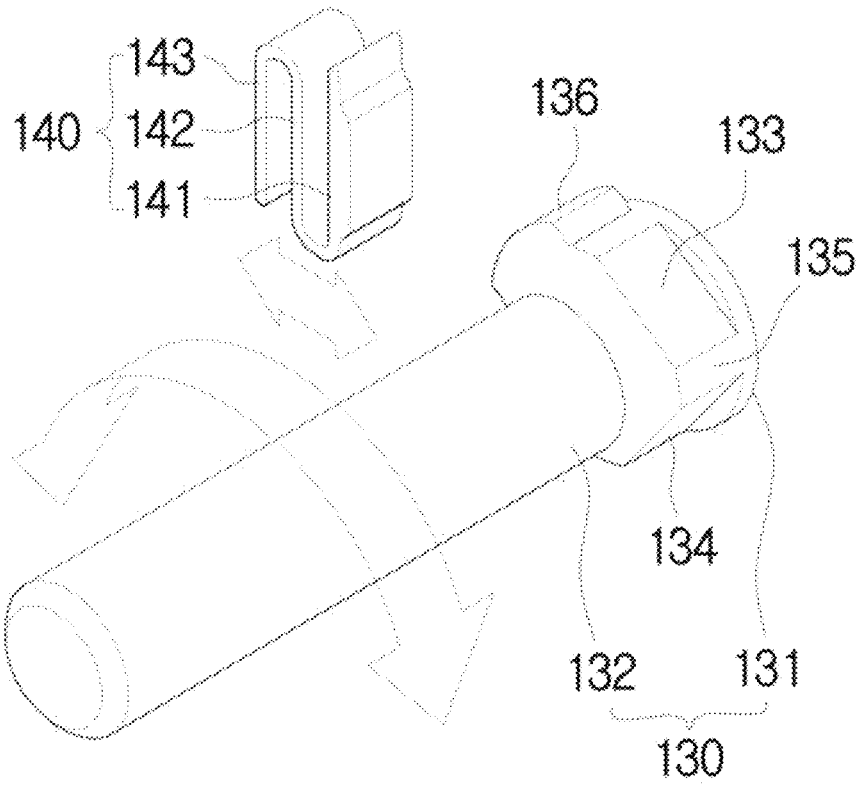
FIG. 1 is a perspective view showing a configuration of the present disclosure.
Figure 2:
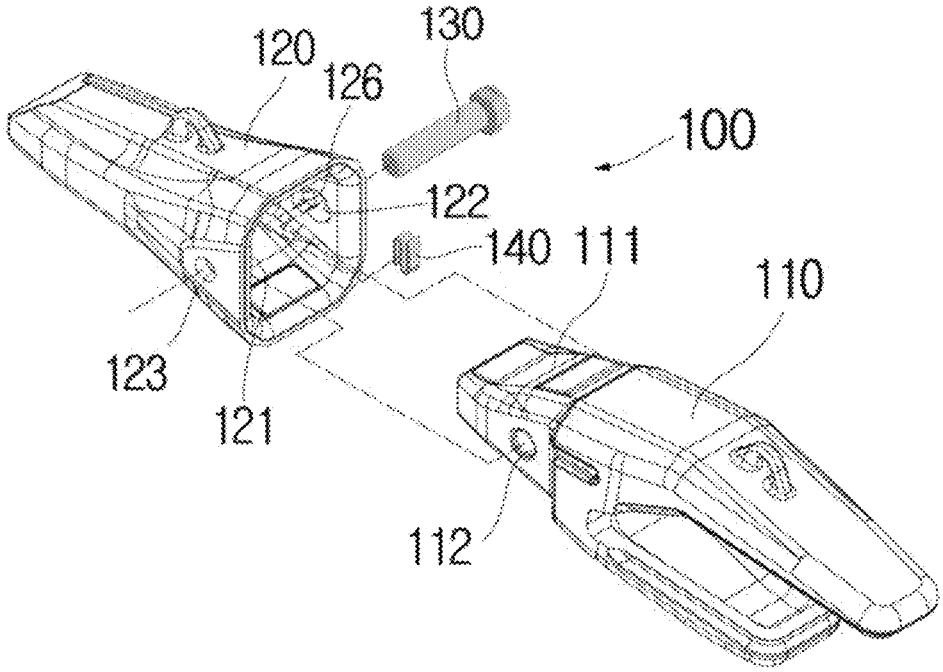
FIG. 2 is an exploded perspective view showing a configuration and application of the present disclosure.
Figure 3:
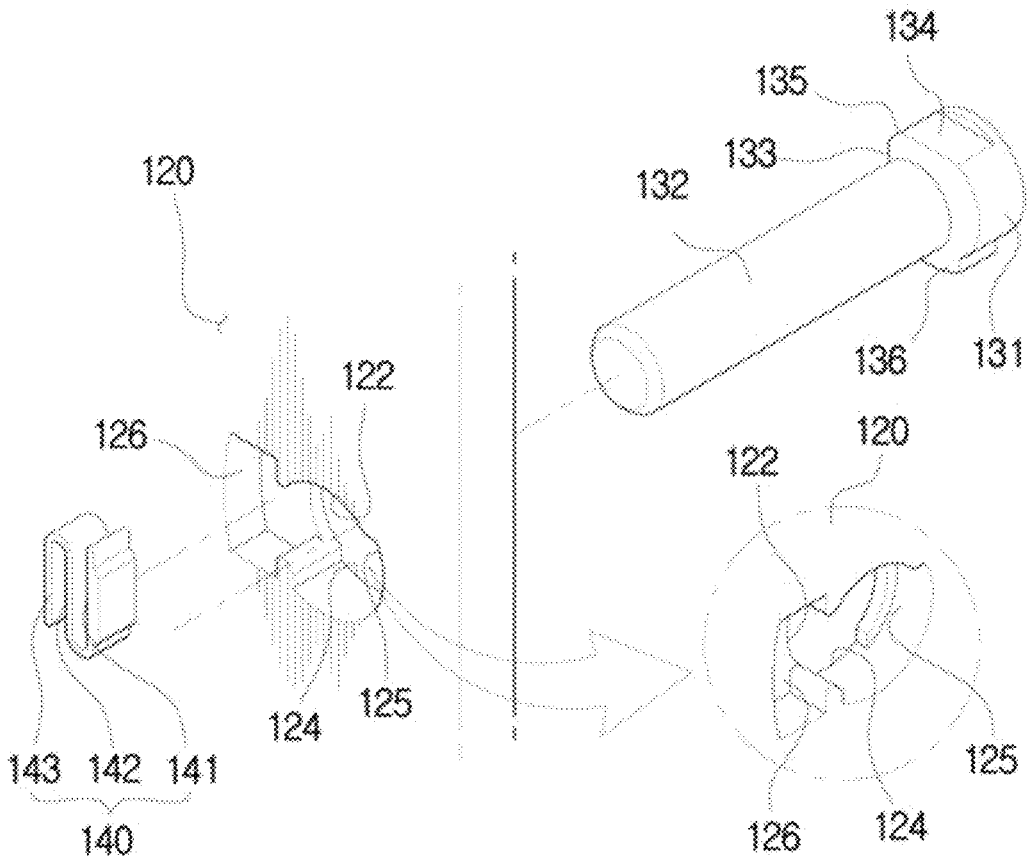
FIG. 3 is an exploded perspective view showing an enlarged configuration and application of the present disclosure.

As shown in FIGS. 1 to 3, a fastening device 100 for different components may include: a first component 110 having a through passage 112 formed at a connecting end 111, which is one end; a second component 120 having an insertion groove 121 into which a connecting end 111 of the first component 110 is introduced, and an inlet hole 122 and an outlet hole 123 formed on opposite sides of the insertion groove 121 to communicate with each other through the through passage 112; a connecting unit (or a connector) 130 capable of securing or releasing by rotating operation positions in a state where the connecting unit 130 is inserted to reach the inlet hole 122, the through passage 112, and the outlet hole 123; and a damper 140 positioned on one side of the connecting unit 130 and configured as a single elastic pressing body that prevents rotation of the connecting unit 130 and maintains a fixed state of the connecting unit 130 by contracting or restoring its original shape according to a rotational operation of the connecting unit 130.

In the present disclosure, the first component 110 may be a tooth adapter connected and fixed to an excavator bucket.

In the present disclosure, the second component 120 may be a tooth point fitted to the connecting end of the tip of the tooth adapter.

In the present disclosure, the connecting unit 130 is configured in such a way that a smaller diameter fastening pin 132 is formed on one side of a relatively larger diameter head 131, and the head 131 is inserted into the inlet hole 122 formed on one side of the second component 120, and the fastening pin 132 passes through the through passage 112 formed in the first component 110 to reach the outlet hole 123 formed on the opposite side of the second component 120.

In the connecting unit 130 of the present disclosure, a first flat surface 133 and a second flat surface 134 forming an angle of 90 degrees may be milled on a part surface of the head 131 in contact with the fastening pin 132, a fillet surface 135 may be formed at the corner between the first flat surface 133 and the second flat surface 134, and the engagement member 136 may protrude from a head surface facing the second flat surface 134.

In the present invention, the damper 140 may have three parallel rows of first, second, and third functional surfaces 141, 142, and 143 spaced apart from each other. The damper 140 may be formed in a zigzag pattern in which a lower part of the first functional surface 141 connected to a lower part of the second functional surface 142 while an upper part of the second functional surface 142 connected to an upper part of the third functional surface 143.

In the damper 140 of the present disclosure, when the connecting unit 130 is rotated from top to bottom and pressed, the upper side of the first functional surface 141 may be pressed and contract, and when the connecting unit 130 is further rotated and pressed, the lower side of the second action surface 142 may contract, and when the connecting unit 130 is even further rotated to release pressure, the damper 140 may restore its original shape due to elasticity.

Specific embodiments of the present disclosure will be described with reference to the accompanying drawings.

First, as shown in FIGS. 1 to 3, the fastening device 100 for different components according to a basic embodiment of the present disclosure may include: a first component 110 having a through passage 112 formed at a connecting end 111, which is one end; a second component 120 having an insertion groove 121 into which a connecting end 111 of the first component 110 is introduced, and an inlet hole 122 and an outlet hole 123 formed on opposite sides of the insertion groove 121 to communicate with each other through the through passage 112; a connecting unit 130 capable of securing or releasing by rotating operation positions in a state where the connecting unit 130 is inserted to reach the inlet hole 122, the through passage 112, and the outlet hole 123; and a damper 140 positioned on one side of the connecting unit 130 and configured as a single elastic pressing body that prevents rotation of the connecting unit 130 and maintains a fixed state of the connecting unit 130 by contracting or restoring its original shape according to a rotational operation of the connecting unit 130.

In the present disclosure, fastening and securing are achieved through rotation of the connecting unit 130 penetrating a connected portion where the first component 110 and the second component 120 are connected. In this state, the damper 140 provides an elastic pressure on the connecting unit 130 to prevent rotation or loosening, thereby effectively maintaining a robust fastening force between the different components, which are the first component 110 and the second component 120.

Here, the first component 110 is exemplified by a tooth adapter that is connected and fixed to an excavator bucket, as illustrated in FIG. 2.

Meanwhile, the second component 120 is exemplified by a tooth point that is fitted to the connecting end of the tip of the tooth adapter, as shown in FIG. 2.

Meanwhile, the connecting unit 130 according to a specific embodiment of the present disclosure is configured in such a way that a smaller diameter fastening pin 132 is formed on one side of a relatively larger diameter head 131, and the head 131 is inserted into the inlet hole 122 formed on one side of the second component 120, and the fastening pin 132 passes through the through passage 112 formed in the first component 110 to reach the outlet hole 123 formed on the opposite side of the second component 120.

For the connecting unit 130 configured as described above, in a state where the tooth point, which is the second component 120, is fitted into the connecting end 111, which is the tip of the tooth adapter fixed to the excavator bucket, which is the first component 110, the above-described connecting unit 130 is inserted through the inlet hole 122 formed on one side of the tooth point, which is the second component 120. Then, the connecting unit passes through the through passage 112 formed in the tooth adapter, which is the first component 110, and is fitted to reach the outlet hole 123 formed on the other side of the tooth point, which is the second component 120. Then, the connecting unit 120 is rotated and the rotated state of the connecting unit 120 is maintained by elastic pressure of the damper 140, thereby enabling easy fastening and fixing of the tooth adapter, which is the first component 110, and the tooth point, which is the second component 120, and also enabling easy releasing and separation thereof in need of replacement.

Figure 4:
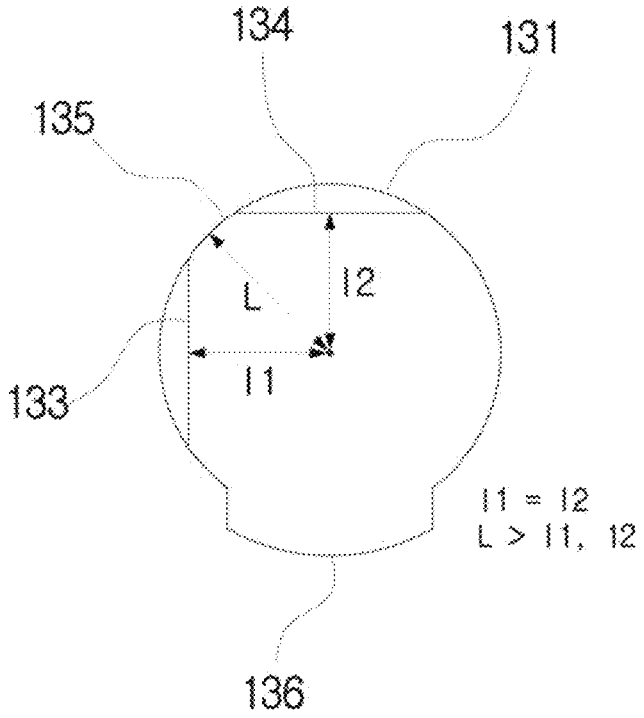
FIG. 4 is a front view of a head, showing a distance to a fillet surface of a connecting unit and a distance to each of first and second flat surfaces.

In this case, as shown in FIGS. 3 and 4, in the connecting unit 130 according to a specific embodiment of the present disclosure, a first flat surface 133 and a second flat surface 134 forming an angle of 90 degrees are milled on a part surface of the head 131 in contact with the fastening pin 132, a fillet surface 135 is formed at the corner between the first flat surface 133 and the second flat surface 134, and the engagement member 136 protrudes from a head surface facing the second flat surface 134.

In this case, during an initial stage of insertion of the connecting unit 130 and during releasing of the connecting unit 130, the first flat surface 133 of the present disclosure is in surface contact with the damper 140 and the connecting unit 130 is detachable from a penetration site.

In this case, also, at a time of fastening and fixing the second flat surface 134 by rotation of the connection unit 130, the second flat surface 134 moves to a position where to come into surface contact with the damper 140 and maintains the surface contact with the damper 140.

In this case, the first flat surface 133 and the second flat surface 134 are brought into contact with the damper 140 in a non-pressed state according to a detailed implementation example. In this state, it is easy to insert and extract the connecting unit 130 into and from the penetration site.

In this case, the first flat surface 133 and the second flat surface 134 are pressed by the elastic pressure of the damper 140 in order to prevent movement of the connecting unit 130 according to another specific embodiment. Here, the elastic pressure of the damper 140 should be sufficient to insert the connecting unit 130 into the penetration site without undue difficulty. In this manner, the elastic pressure of the damper 140 prevents unintended detachment or movement of the connecting unit 130 inserted into the penetration site.

In this case, as shown in FIG. 4, a length L from a center point of the connecting unit 130 to the fillet surface 135 may be longer than lengths l1 and l2 from the center point to the first and second flat surfaces 133 and 134 ("1" refers to the lowercase letter "L").

Only during a forced rotational operation of the connecting unit 130, the fillet surface 135 overcomes the elastic pressure of the damper 140 and moves to change in position to facilitate the directional transition of the first flat surface 133 and the second flat surface 134, and the fillet surface 135 acts as an engagement device to maintain a state resulting from the directional transition until another forced rotational operation of the connecting unit 130 occurs.

As described above, the connecting unit 130 is configured in such a way that a cut surface is formed in the circular head 131 to have the first flat surface 133 and the second flat surface 134 form an angle of 90 degrees, and the fillet surface 135 having a predetermined with is formed at a corner where the second flat surface 134 contacts. In this case, the length L from the center point of the connecting unit 130 to the fillet surface 135 is in the form of protruding longer than the lengths l1 and l2 from the center point to the first and second flat surfaces 133 and 134. Thus, only when a predetermined level of force or more is applied to forcibly rotate the connecting unit 130, the fillet surface 130 rotates while pushing and pressing the damper 140, and in cases where a force less than the predetermined level of force is applied, the connecting unit 130 does not rotate nor move.

In this case, the engagement member 136 according to a specific embodiment of the present disclosure is inserted through a mounting groove 124 formed in the inlet hole 122, and when the connecting unit 130 is rotated, the engagement member 136 may engage by moving along an arc-shaped guide groove 125 formed along a rotating direction on the inner surface of the inlet hole 122.

As described above, when the connecting unit 130 is rotated in a direction toward the guide groove 125 in a state where the engagement member 136 is inserted through the mounting groove 124 formed in the inlet hole 122, the engagement member 136 engages by moving along the arc-shaped guide groove 125 formed on the inner surface of the inlet hole 122, thereby preventing the connection unit 130 from being separated in a direction of insertion when the connection unit 130 is fitted into the penetration site.

Meanwhile, the damper 140 according to a specific embodiment of the present disclosure has three parallel rows of first, second, and third functional surfaces 141, 142, and 143 spaced apart from each other, and the damper 140 is formed in a zigzag pattern in which a lower part of the first functional surface 141 connected to a lower part of the second functional surface 142 while an upper part of the second functional surface 142 connected to an upper part of the third functional surface 143.

In this case, the damper 140 of the present disclosure is in the form of 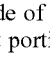 or 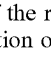 as an example of a specific embodiment.

As described above, the damper 140 of the present disclosure is configured as a single body in the form of 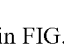 or 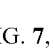 to have a simple structure, thereby making it easy to manufacture and install the damper 140, and operating the damper 140 in an installed is also simple, causing fewer operating errors.

In this case, the damper 140 of the present disclosure may be formed of a metal material having heat resistance.

As described above, the damper 140 of the present disclosure is formed of a metal material having heat resistance, thereby minimizing shape deformation or damage due to thermal stress during use in a high temperature environment. This also minimizes the shortening of lifespan.

In the damper 140 configured as described above, when the connecting unit 130 is rotated counterclockwise and pressed for fastening, the upper part of the first functional surface 141 is pressed and contracts, when the connecting unit 130 is rotated counterclockwise by 45 degrees and pressed, the lower part of the second functional surface 142 contracts, and when the connecting unit 130 is rotated counterclockwise by 90 degrees to release pressure, the damper 140 restores its original shape due to elasticity, maintaining the fastened state of the connecting unit 130. On the other hand, when the connecting unit 130 is rotated clockwise to release pressure, the lower part of the second functional surface 142 is pressed and contracts, and when the connecting unit 130 is rotated clockwise by 45 degrees and pressed, the lower part of the second functional surface 142 contracts further, and when the connecting unit 130 is rotated clockwise by 90 degrees to release pressure, the damper 140 restores its original shape due to elasticity, thereby enabling the release and detachment of the connecting unit 130.

In this case, the damper 140 of the present disclosure may be inserted into and fixed to a receiving space 126 communicatively formed on one side of the inlet hole 122 having the connecting unit 130 inserted therein.

In this case, the damper 140 may be in surface contact with the connecting unit 130 through a communicative portion of the receiving space 126.

In this case, according to a specific embodiment, the damper 140 is fixed while being pressed with a predetermined force in the receiving space 126 by its own elastic force. In doing so, it is possible to fix the damper 140 to the receiving space 126 even without a separate means for fixation.

Figure 5:
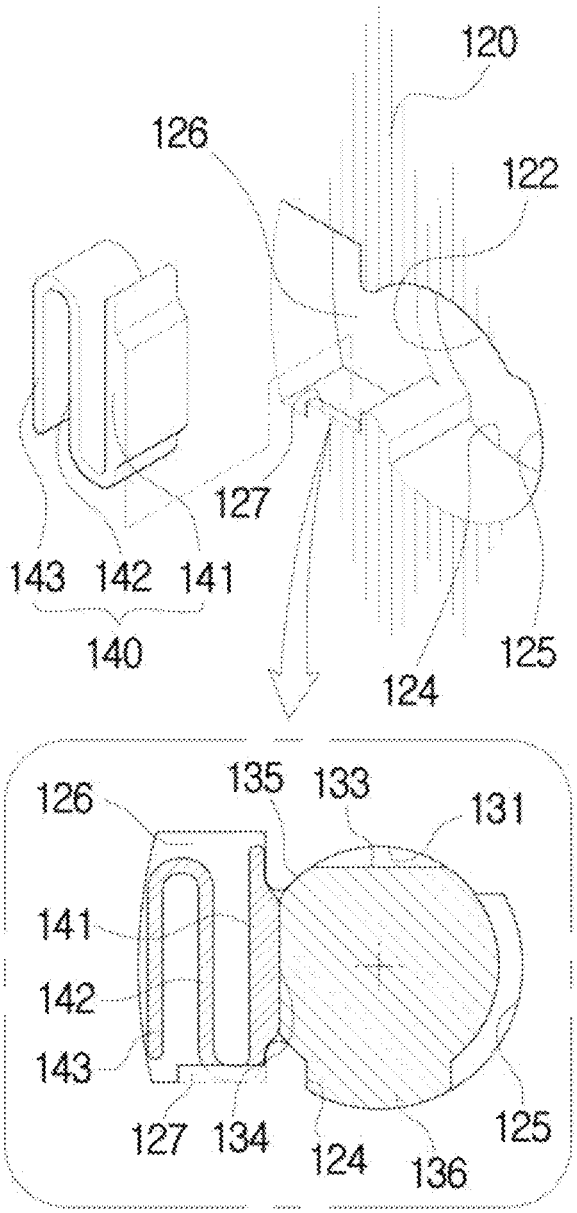
FIG. 5 is a partially exploded perspective view and a front view showing an example of a fixing structure and a fixing state of a damper of the present disclosure.

In this case, the damper 140 according to another detailed embodiment of the present disclosure is configured in a such a manner in which separation of the damper 140 received in the receiving space 126 is prevented due to a step 127 formed in a lower side of the receiving space 126, as shown in FIG. 5.

Here, the lower part of the damper 140 may be inserted into a lower portion of the receiving space 126 where the step 127 is formed, and then the upper part of the damper 140 may be pushed into and fixed in the receiving space 126 in an upwardly erected state.

Figure 6:
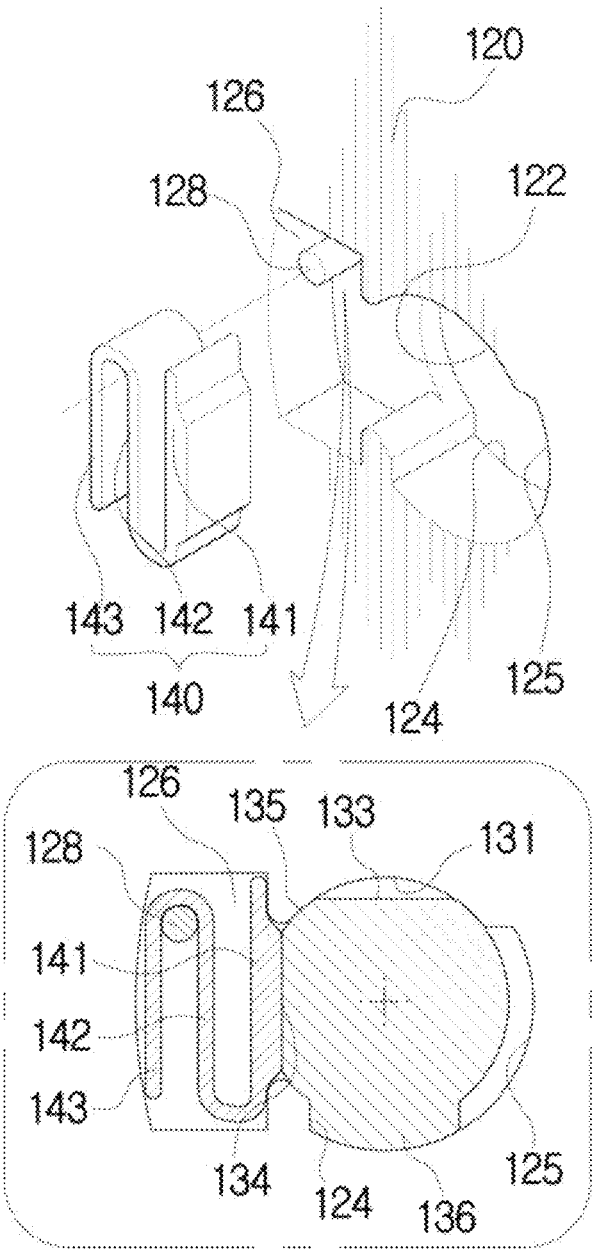
FIG. 6 is a partially exploded perspective view and a front view showing another example of a fixing structure and a fixed state of a damper of the present disclosure.

In this case, also, as shown in FIG. 6, the damper 140 according to yet another embodiment of the present disclosure is configured in such a way that, in a process of being received in the receiving space 126, an upper end of one side of the damper 140 is fitted and fixed to a holding pin 128 protruding in the upper side of the receiving space 126.

Here, a curved and bent portion of the upper end of one side of the damper 140 in the form of  may be fitted to the holding pin 128, so that the damper 140 can be fixed in the receiving space 126.

Figure 7:
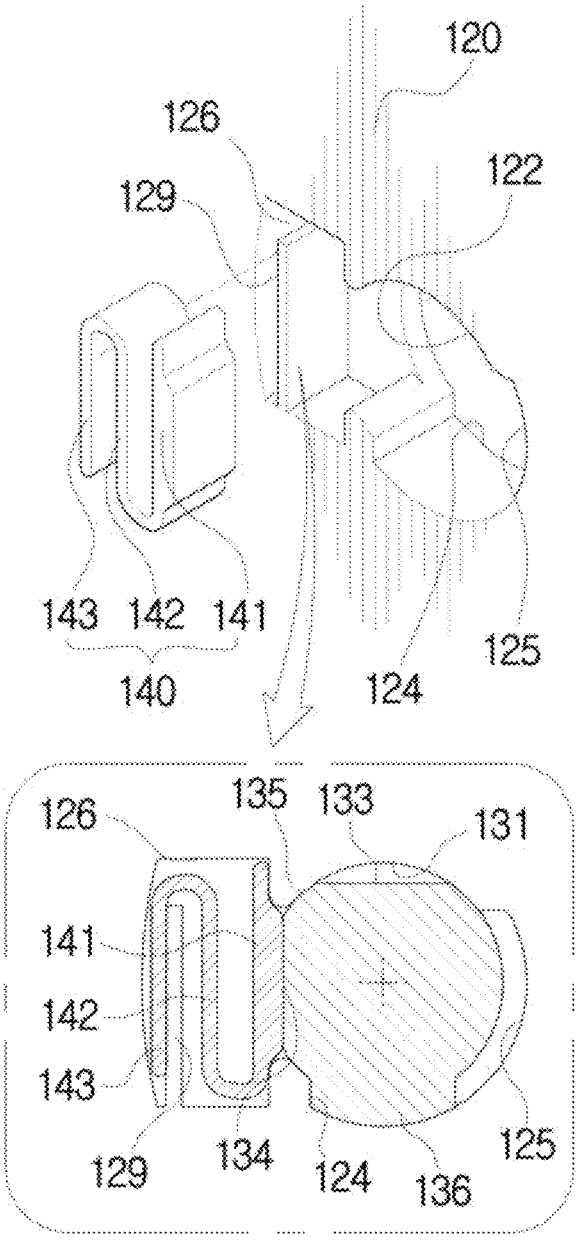
FIG. 7 is a partially exploded perspective view and a front view showing yet another example of a fixing structure and a fixed state of a damper of the present disclosure.

At this point, as shown in FIG. 7, in the process of being received in the receiving space 126, an end of one side of the damper 140 may be fitted and fixed to a fixing protruding piece 129 vertically protruding in a rear side of the receiving space 126.

In doing so, a vertical slit portion, which is formed on one side of the damper 140 in the form of , may be fitted to and secured by the fixing protruding piece 129.

At this point, when a thickness of a functional surface on one side of the damper 140 coincides with a distance between the fixing protruding piece 129 and an inner wall on one side of the receiving space 126, or when the thickness of the functional surface is relatively thicker, it is possible to fix the damper 140 to the fixing protruding piece 129 in a forcibly fitting manner.

The fastening operation of the present disclosure as described above is shown in FIGS. 8 to 11.

Figure 8:
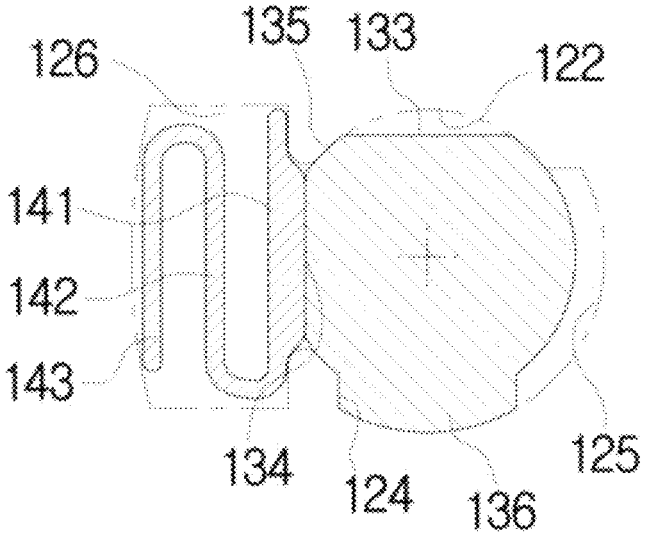
FIGS. 8 to 11 are front views showing a locking operation of the present disclosure step by step.

First, in a state where the tooth point, which is the second component 120, is fitted into the connecting end 111, which is the tip of the tooth adapter fixed to the excavator bucket, which is the first component 110, the connecting unit 130 is inserted through the inlet hole 122 formed on one side of the tooth point, which is the second component 120. Then, the connecting unit passes through the through passage 112 formed in the tooth adapter, which is the first component 110, and is fitted to reach the outlet hole 123 formed on the other side of the tooth point, which is the second component 120. Then, as shown in FIG. 8, in a state where the head 131 of the connecting unit 130 is positioned in the inlet hole 122, the engagement member 136 is inserted through the mounting groove 124 formed in the inlet hole 122 and thereby positioned in the inlet hole 122.

In this case, as described above, the damper 140 has three parallel rows of first, second, and third functional surfaces 141, 142, and 143 spaced apart from each other, and the damper 140 is formed in a zigzag pattern in which a lower part of the first functional surface 141 connected to a lower part of the second functional surface 142 while an upper part of the second functional surface 142 connected to an upper part of the third functional surface 143.

Figure 9:
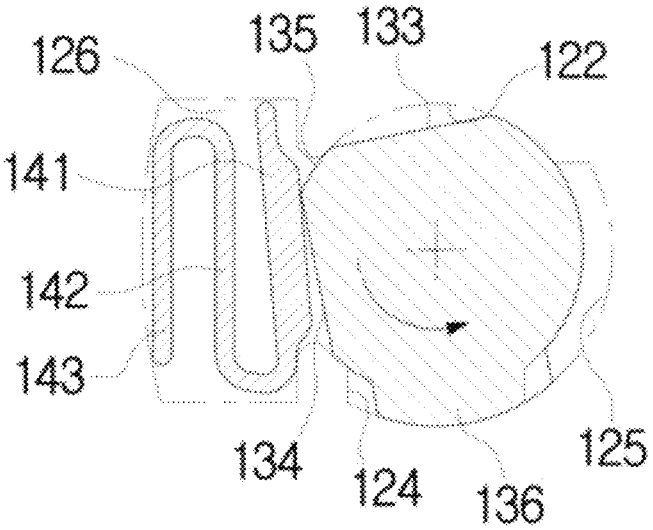

In this case, when a predetermined force is applied to rotate the connecting unit 130 counterclockwise, as shown in FIG. 9, the fillet surface 135 protruding from the first flat surface 133 is rotated from the top to the bottom, thereby pressing and pushing the upper end of one side of the damper 140, that is, the upper end of the first function surface 141, to contract.

Figure 10:
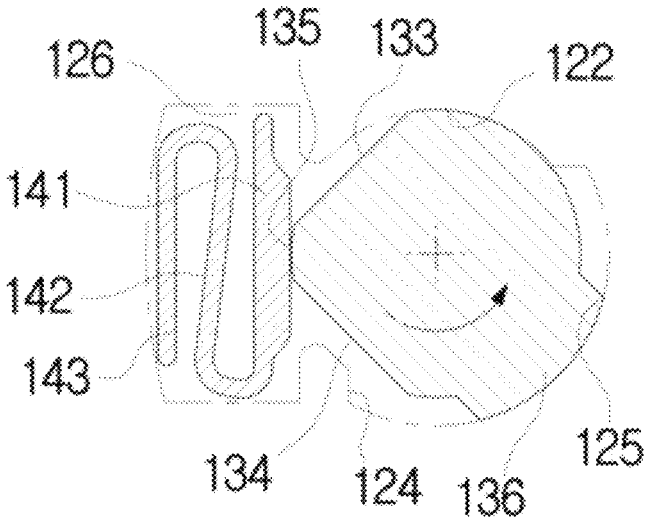

In this process, when a predetermined force is applied to the connecting unit 130 to further rotate (45 degrees), the fillet surface 135 of the connecting unit 130 is located in the middle of the first functional surface 141, as shown in FIG. 10. In this case, the lower part of the second functional surface 142 of the damper 140 contracts and is pushed toward the third functional surface 143.

Figure 11:
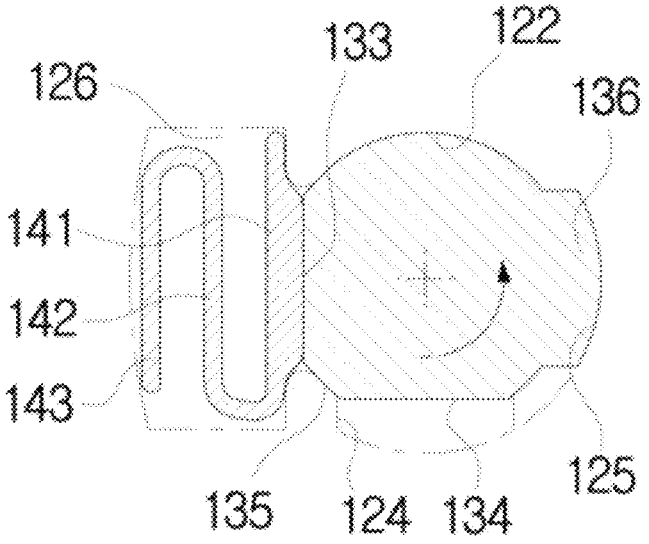

Then, when a predetermined force is applied to the connecting unit 130 to further rotate (90 degrees), the fillet surface 135 of the connecting unit 130 moves downward over the lower side of the first functional surface 141 of the damper 140, as shown in FIG. 11, and the damper 140 rebounds and restores its original shape by its own elasticity. In this case, the second flat surface 134 of the connecting unit 130 is in surface contact with the damper 140.

In this case, during the rotation of the connecting unit 130 as described above, in a state where engagement member 136 is inserted through the mounting groove 124 formed in the inlet hole 122, the engagement member 136 engages by engaging and moving through the guide groove 125 formed in the inner surface of the inlet hole 122.

An angle of the rotation of the connecting unit 130 is 90 degrees.

The releasing and separating operation of the present disclosure is as shown in FIGS. 12 to 15.

Figure 12:
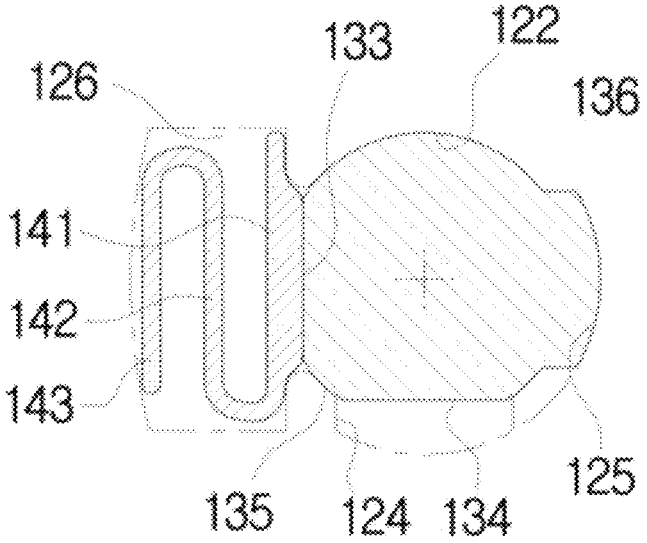
FIGS. 12 to 15 are front views showing a releasing operation of the present disclosure step by step.

First, in a state in which the first member 110 and the second member 120 are coupled to each other through the connecting unit 130 as described above, the second flat surface 134 is in surface contact with the damper 140 and the engagement member 136 is guided and fixed along the guide groove 125 formed in the inlet hole 122, as shown in FIG. 12.

Figure 13:
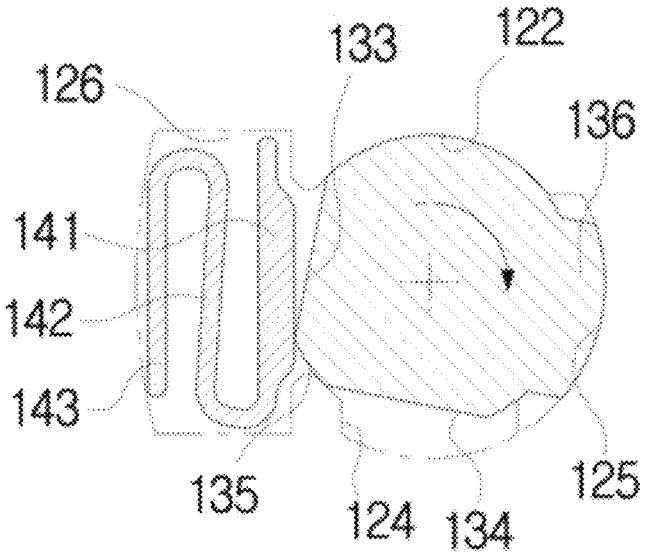

In this case, when a predetermined force is applied to the connecting unit 130 to rotate clockwise, the fillet surface 135 protruding from the second flat surface 133 moves from the bottom to the top, as shown in FIG. 13. In this case, the lower part of the second functional surface 142 of the damper 140 contracts and is pushed toward the third functional surface 143.

Figure 14:
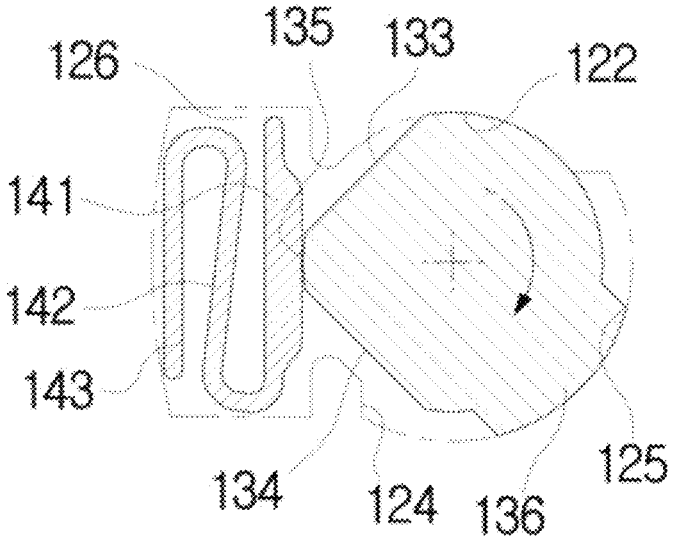
Figure 15:
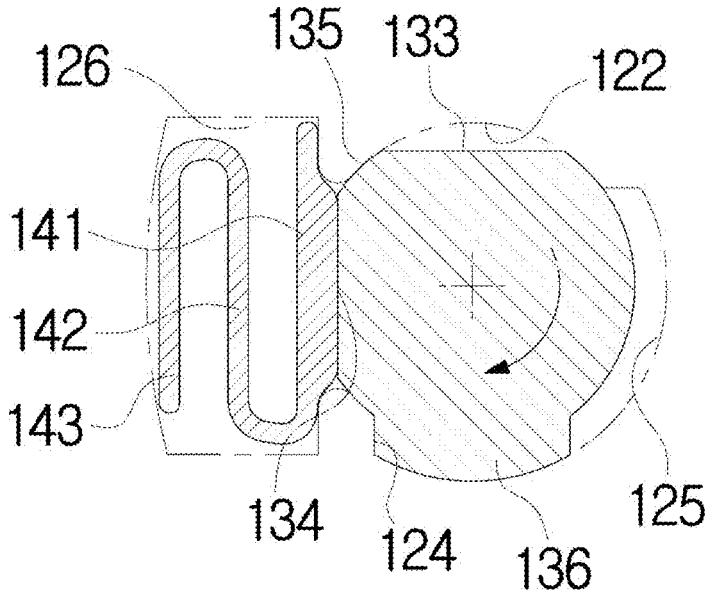

In this process, when a predetermined force is applied to the connecting unit 130 to further rotate (45 degrees), the fillet surface 135 of the connecting unit 130 is located in the middle of the first functional surface 141, as shown in FIG. 14. In this case, the lower part of the second functional surface 142 of the damper 140 further contracts and is pushed toward the third functional surface 143.

Thereafter, when a predetermined force is applied to the connecting unit 130 to further rotate the connecting unit 130, the upper part of the first functional surface 141 is pressed and contracted. In this case, when a predetermined force is applied to the connecting unit 130 to further rotate the connecting unit 130 (by 90 degrees), the fillet surface 135 of the connecting unit 130 moves upward over the upper part of the first functional surface 141 of the damper 140, the damper 140 rebounds and restores its original shape. At this point, the first flat surface 134 of the connecting unit 130 is in surface contact with the damper 140. In this case, since the elasticity of the damper 140 does not greatly act on the connecting unit 130, it may be easy to release (separate) the connecting unit 130 in the connected state.

In the present disclosure, the connecting unit 130 passes through a connected portion between the first component 110 and the second component 120 and is then fastened and secured by rotational operation, and in this state, the damper 140 provides an elastic force exerting to the connecting unit 130 to prevent rotational or vibrational detachment, thereby maintaining a strong fixation force between the different components, the first component 110 and the second component 120.

In the present disclosure, in a state where the tooth point, which is the second component 120, is fitted into the connecting end 111, which is the tip of the tooth adapter fixed to the excavator bucket, which is the first component 110, the above-described connecting unit 130 is inserted through the inlet hole 122 formed on one side of the tooth point, which is the second component 120. Then, the connecting unit passes through the through passage 112 formed in the tooth adapter, which is the first component 110, and is fitted to reach the outlet hole 123 formed on the other side of the tooth point, which is the second component 120. Then, the connecting unit 120 is rotated and the rotated state of the connecting unit 120 is maintained by elastic pressure of the damper 140, thereby enabling easy fastening and fixing of the tooth adapter, which is the first component 110, and the tooth point, which is the second component 120, and also enabling easy releasing and separation thereof in need of replacement.

In the present disclosure, the damper 140 of the present disclosure is configured as a single body in the form of 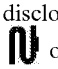 or 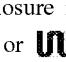 to have a simple structure, thereby making it easy to manufacture and install the damper 140, and operating the damper 140 in an installed is also simple, causing fewer operating errors.

In the present disclosure, the damper 140 of the present disclosure is formed of a metal material having heat resistance, thereby minimizing shape deformation or damage due to thermal stress during use in a high temperature environment. This also minimizes the shortening of lifespan.

The technical features disclosed in each embodiment of the present disclosure are not limited to a corresponding embodiment, and unless incompatible with each other, the technical features disclosed in each embodiment may be applied in combination to other embodiments.

Therefore, although each embodiment is described mainly about an individual technical feature, the technical features of the embodiments of the present disclosure may be applied in combination, unless incompatible with each other.

The present disclosure is not limited to the above-described embodiments and the accompanying drawings, and various modifications and changes may be made in view of a person skilled in the art to which the present disclosure pertains. Therefore, the scope of the present disclosure should be determined by the scope of the appended claims, and equivalents thereof.

What is claimed is:

1. A fastening device for different components, the device comprising:

a first member comprising a connecting end, the connecting end having a through passage formed therethrough;

a second member comprising an insertion groove into which the connecting end of the first member is inserted, and an inlet hole and an outlet hole formed on opposite facing surfaces of the insertion groove, the inlet hole and the outlet hole being aligned with the through passage so as to communicate with the through passage;

a connecting unit configured to be selectively fastened or released according to a rotational operation position, the connecting unit being inserted so as to extend through the inlet hole, the through passage, and the outlet hole; and a damper positioned on one side of the connecting unit, wherein the damper comprises at least three parallel functional surfaces arranged in a zigzag pattern as a one-piece elastic metal strip, the functional surfaces being connected by alternating upper and lower bends, each functional surface undergoing elastic deformation in response to rotational movement of the connecting unit, wherein the zigzag pattern provides progressive resistance against rotational forces, enabling staged energy absorption and ensuring controlled rotation of the connecting unit, wherein the deformation of the damper occurs in discrete stages corresponding to predefined rotational angles of the connecting unit, such that:

a first functional surface contracts when the connecting unit is rotated by a first predetermined angle, and a second functional surface contracts when the connecting unit is rotated by a second predetermined angle, and the damper restores to an original shape due to elasticity when the connecting unit returns to a release position, thereby enabling the connecting unit to maintain a stable fastening state when rotated into a fastened position, wherein each functional surface sequentially deforms to distribute rotational force incrementally, preventing sudden stress accumulation and prolonging operational lifespan of the fastening device, wherein an elastic pressure exerted by the damper prevents unintentional rotation or loosening of the fastening device while allowing controlled manual operation, and wherein the controlled manual operation is facilitated by a predefined resistance threshold that allows rotation of the connecting unit only when a specified torque is applied.

2. The fastening device of claim 1, wherein the first member is a tooth adapter connected and fixed to an excavator bucket.

3. The fastening device of claim 1, wherein the second member is a tooth point fitted to a connecting end of a tip of a tooth adapter.

4. The fastening device of claim 1, wherein the connecting unit is configured in such a way that a smaller diameter fastening pin is formed on one side of a relatively larger diameter head, wherein the head is inserted into the inlet hole formed on one side of the second member and the fastening pin passes through the through passage formed in the first member to reach the outlet hole formed on the opposite side of the second member.

5. The fastening device of claim 1, wherein the connecting unit is configured in such a way that a first flat surface and a second flat surface forming an angle of 90 degrees are milled on a part surface of a head in contact with a fastening pin, a fillet surface is formed at a corner between the first flat surface and the second flat surface, and an engagement member protrudes from a head surface facing the second flat surface.

6. The fastening device of claim 5, wherein the first flat surface is in surface contact with the damper during an initial stage of insertion of the connecting unit and during releasing of the connecting unit.

7. The fastening device of claim 5, wherein the second flat surface is in surface contact with the damper at a time of fastening and fixing by a rotational operation of the connecting unit.

8. The fastening device of claim 5, wherein the first flat surface and the second flat surface are in surface contact with the damper in a non-pressed state.

9. The fastening device of claim 5, wherein the first flat surface and the second flat surface are pressed by elastic pressure of the damper to prevent movement of the connecting unit.

10. The fastening device of claim 5, wherein only during a forced rotational operation of the connecting unit, the fillet surface moves to change in position by overcoming elastic pressure of the damper, thereby facilitating a directional transition of the first flat surface and the second flat surface, and the fillet surface engages with the damper to maintain the connecting unit in the transitioned state until another forced rotational operation is performed.

11. The fastening device of claim 5, wherein a length from a center point of the connecting unit to the fillet surface is longer than a length from a center point to the first and second flat surfaces.

12. The fastening device of claim 5, wherein the engagement member is inserted through a mounting groove formed in the inlet hole, and when the connecting unit is rotated, the engagement member engages by moving along an arc-shaped guide groove formed along a rotational direction on an inner surface of the inlet hole.

13. The fastening device of claim 1, wherein a lower part of the first functional surface is connected to a lower part of the second functional surface while an upper part of the second functional surface is connected to an upper part of a third functional surface.

14. The fastening device of claim 1, wherein the damper is formed of an elastic metal material in the form of 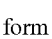 .

15. The fastening device of claim 1, wherein the damper is formed of an elastic metal material in the form of 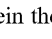 .

16. The fastening device of claim 13, wherein:

when the connecting unit is rotated counterclockwise and pressed for fastening, an upper part of the first functional surface is pressed and contracts, when the connecting unit is rotated counterclockwise by 45 degrees and pressed, the lower part of the second functional surface contracts, and when the connecting unit is rotated counterclockwise by 90 degrees to release pressure, the damper restores its original shape due to elasticity, thereby securing the connecting unit in the fastened position, and when the connecting unit is rotated clockwise to release pressure, the lower part of the second functional surface is pressed and contracts, when the connecting unit is rotated clockwise by 45 degrees and pressed, the lower part of the second functional surface contracts further; and when the connecting unit is rotated clockwise by 90 degrees to release pressure, the damper restores its original shape due to elasticity, thereby enabling the release and detachment of the connecting unit.

17. The fastening device of claim 1, wherein the damper is inserted into and fixed to a receiving space communicatively formed on one side of the inlet hole into which the connecting unit is inserted.

18. The fastening device of claim 17, wherein the damper is in surface contact with the connecting unit through a communicative portion of the receiving space.

19. The fastening device of claim 17, wherein the damper is fixed in the receiving space by its own elastic force.

20. The fastening device of claim 17, wherein separation of the damper received in the receiving space is prevented due to a step formed in a lower side of the receiving space.

21. The fastening device of claim 17, wherein in a process for receiving the damper in the receiving space, an end of one side of the damper is fitted and fixed to a holding pin protruding in an upper side of the receiving space.

22. The fastening device of claim 17, wherein in a process for receiving the damper in the receiving space, an end of one side of the damper is fitted and fixed to a fixing protruding piece protruding vertically in a rear side of the receiving space.

23. The fastening device of claim 1, wherein, during rotation of the connecting unit from the release position toward the fastened position, an upper region of the first functional surface is elastically compressed between 0° and 45°, a lower region of the second functional surface is compressed at 45°, and the damper elastically restores at 90°.

24. The fastening device of claim 1, wherein the connecting unit comprises a head having a first flat surface and a second flat surface intersecting at 90°, and a fillet surface between the first and second flat surfaces, a radial distance L from a rotation center of the connecting unit to the fillet surface being greater than radial distances l1 and l2 from the rotation center to the first and second flat surfaces, respectively.

* * * * *